United States Patent [19]

Couper et al.

[11] Patent Number: 4,582,385

[45] Date of Patent: Apr. 15, 1986

[54] ELECTRICAL CONNECTOR EMBODYING ELECTRICAL CIRCUIT COMPONENTS

[75] Inventors: William D. Couper, Tempe; David W. DeChamp; Alfred R. Erbe, both of Phoenix, all of Ariz.

[73] Assignee: International Telephone & Telegraph Corp., New York, N.Y.

[21] Appl. No.: 547,158

[22] Filed: Oct. 31, 1983

[51] Int. Cl.[4] ..... H01R 13/66

[52] U.S. Cl. ..... 339/147 R; 339/14 R

[58] Field of Search ..... 333/181-185; 339/143 R, 147 R, 14 R, 217 R, 103 M, 126 J, 177 R, 177 E

[56] References Cited

U.S. PATENT DOCUMENTS

| | | | |
|---|---|---|---|
| 3,648,222 | 3/1972 | Cowmeadow | 333/183 X |
| 3,705,379 | 12/1972 | Bogar | 339/177 R |
| 3,781,723 | 12/1973 | Harwood | 333/183 |
| 3,825,874 | 7/1974 | Peverill | 339/143 R X |
| 4,199,736 | 4/1980 | McTaggart et al. | 339/126 J X |
| 4,402,566 | 9/1983 | Powell et al. | 339/217 R X |

OTHER PUBLICATIONS

Whittaker, B. F., "A Mass Termination, Filtered Connector for RS-232-C Circuits, 10-1980.

*Primary Examiner*—Eugene F. Desmond

*Attorney, Agent, or Firm*—T. L. Peterson; R. C. Turner

[57] ABSTRACT

An electrical connector containing contacts upon which there are mounted electrical circuit components. A component is mounted on the side of each contact. A ground plate in the connector shell embodies a spring tang for each contact that provides electrical connection between the component and the shell. Matching polarizing surfaces on each contact and the wall of its corresponding contact cavity correctly positions the contact so that the electrical component thereon will be engaged by the spring tang.

6 Claims, 10 Drawing Figures

ELECTRICAL CONNECTOR EMBODYING ELECTRICAL CIRCUIT COMPONENTS

BACKGROUND OF THE INVENTION

The present invention relates generally to an electrical connector and, more particularly, to a connector in which the contacts therein carry electrical circuit components.

U.S. Pat. No. 3,670,292 to Tracy discloses a filter connector in which filter contacts are mounted in openings in a metallic ground foil which makes electrical connection between the filters on the contacts and the shell of the connector. The filter element on each contact is of cylindrical form, and surrounds the contact body.

U.S. Pat. No. 3,790,858 to Brancaleone et al. discloses an electrical connector in which electrical circuit components, such as magnetic pulse absorbers or radio frequency filter elements, are integrated into an electrical connector by mounting the same within a grounding plate in the shell of the connector spaced from insulated contacts which extend through openings in the plate. Conductors of the circuit components are connected to selected electrical contacts in the connector by means of a printed circuit board which is removably mounted in the shell of the connector.

Copending application of G. R. Nieman et al. entitled "Electrical Connector Embodying Electrical Circuit Components," Ser. No. 480,169, filed Mar. 29, 1983, assigned to the same assignee as the present application, discloses an electrical connector member in which one or more electrical circuit components are mounted on the side of each contact, rather than surrounding the contact body as in prior art filter connectors, such as disclosed in the aforementioned Tracy et al. patent. The components may be a bipolar diode for transient suppression and a capacitor for filtering. The components are mounted in a notch formed in the side of the contact body. Electrical connection is made between the components and a relatively thick ground plate in the connector shell by means of a spring element mounted on the components. Such connector utilizes fewer parts, is less expensive to manufacture, and may be made smaller in size for permitting a very high density arrangement of the contacts as compared to the connector disclosed in the aforementioned Brancaleone et al. patent incorporating pulse absorbers and filter elements.

While the Nieman et al. connector is entirely satisfactory, it would be desirable to further reduce the number of parts and cost of manufacture of the connector. Furthermore, since the spring elements that provide electrical connection between the electronic components on the contacts and the ground plate are mounted on the contacts, by necessity the spring elements must protrude beyond the outer surface of the contact bodies. As a consequence, it is possible that the spring elements may become snagged or damaged during handling of the contacts before they are inserted into the connector body.

It is the object of the present invention to provide a connector similar to that disclosed in the Nieman et al. patent which has fewer parts, is less expensive to manufacture, and avoids the use of exposed spring elements mounted on the contacts.

SUMMARY OF THE INVENTION

According to a principal aspect of the present invention, there is provided an electrical connector member in which an electrical circuit component is mounted on the side of each contact mounted in the connector. However, rather than mounting an individual spring on the component of each contact for engaging a thick ground plate as in the aforementioned Nieman et al. connector, according to the present invention there is provided a relatively thin ground plane or foil in the connector shell which embodies integral resilient tangs that engage the electrical components on the contacts. Polarizing means is provided which cooperates with each contact that permits the contact to be mounted in the connector in a predetermined angular position wherein the component on the contact will be engaged by the tang on the ground foil. Such connector has fewer parts, is less expensive to manufacture and assemble, and avoids the use of individual springs connected to the electrical circuit components on the contacts which might become damaged during handling of the contacts.

DESCRIPTION OF THE PREFERRED EMBODIMENTS

Figure 1:
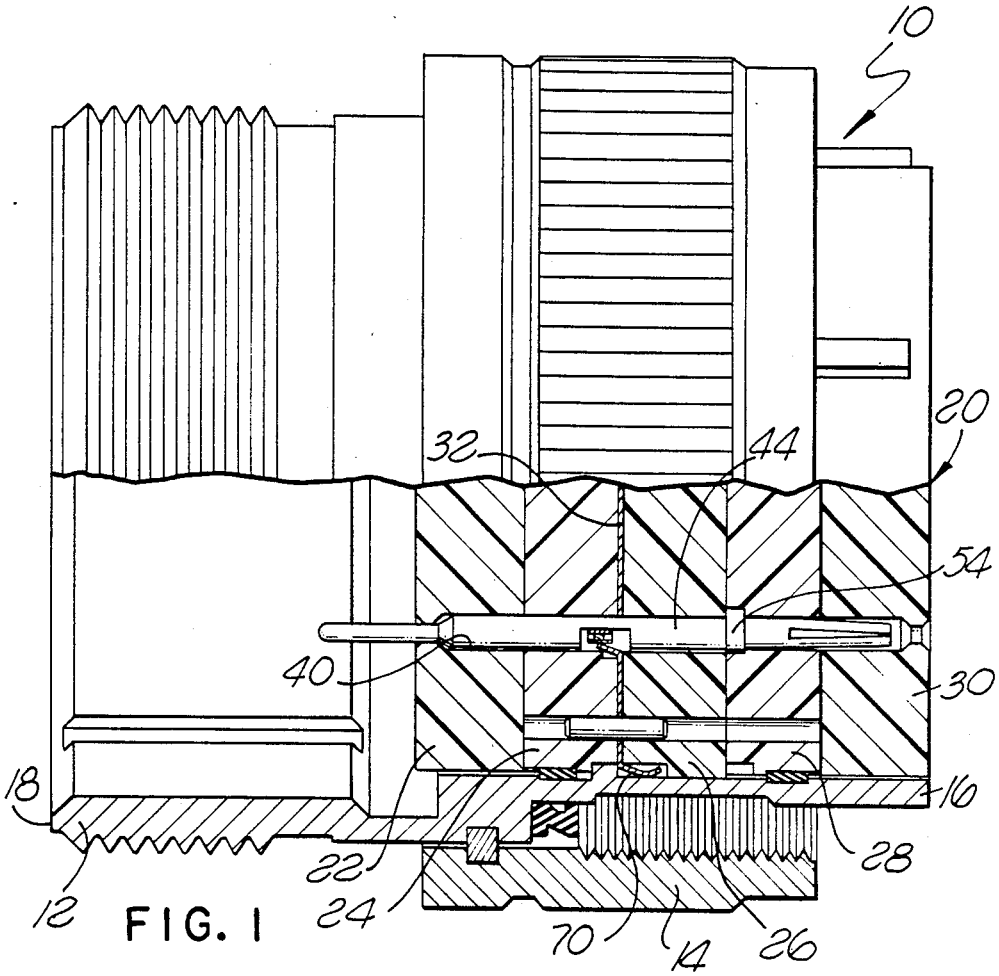
FIG. 1 is a partial longitudinal sectional view through a connector adapter embodying the present invention, with only one contact being shown therein.

The present invention will be described herein as being incorporated in an electrical connector member in the form of an adapter which may be connected between standard mating plug and receptacle halves of a connector assembly. However, it will be appreciated that the invention may be incorporated in either the plug half, or receptacle half of a connector.

Reference is made to FIGS. 1 to 6 in detail which illustrate the first embodiment of the connector member adapter of the present invention. The connector member adapter, generally designated 10, comprises a metallic shell 12 having a coupling nut 14 rotatably mounted thereon for connecting the rear 16 of the adapter 10 to a receptacle connector member, not shown. The forward end 18 of the shell 12 is adapted to engage a mating plug connector member, likewise not shown.

The shell 12 contains an insert or insulator assembly 20 comprising a front elastomeric insulator 22, a front hard insulator 24, two rear hard insulators 26 and 28, and a rear elastomeric insulator 30. A metal ground plate 32 is disposed between the hard insulators 24 and 26.

A plurality of aligned openings extend through the insulators 22, 24, 26, 28 and 30 providing contact passages 40. An opening 42 is formed in the ground plate 32 coaxial with each passage 40. A contact, generally designated 44, is mounted in each contact passage 40, and extends through the corresponding opening 42 in the ground plate.

The contact 44 comprises a generally cylindrical contact body 46 having a forward mating end 48, shown in the form of a pin contact, an intermediate section 50 and a rear mating end 52, which is shown as being in the form of a socket contact. Thus, for the adapter 10 the contact is a double ended pin and socket contact. If the connector were in the form of either a plug or receptacle connector half, rather than an adapter, the rear end of the contact would be in the form of a solder pot, a crimp barrel, or the like.

The contact 44 embodies an outwardly extending annular flange 54 between the intermediate section 50 and rear mating end 52. Such flange is mounted in a counterbore 55 in the front of the insulator 28. The flange is trapped between the bottom of the counterbore and the rear face of the insulator 26 to retain the contact in the insulator assembly.

A notch or recess 56 is formed in the intermediate section 50 of the contact in such a position that the notch will be generally aligned with the ground plate 32 when the contact is mounted in the insulator assembly 20.

Figure 5:
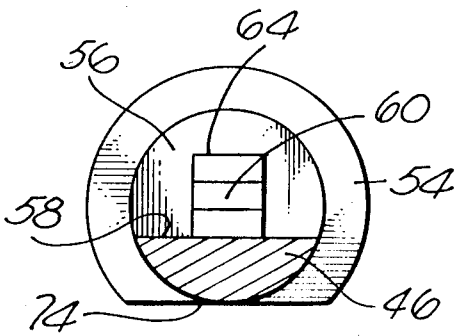
FIG. 5 is a transverse sectional view taken along line 5—5 of FIG. 4.

The bottom 58 of the notch forms a flat supporting surface on which there is mounted an electrical circuit component 60. The circuit component may be, for example, a bipolar diode for transient suppression or a capacitor for filtering. The circuit component has a lower conductive layer 62 which is soldered to the supporting surface 58 of the contact, and an upper conductive layer 64. As best seen in FIG. 5, the circuit component is dimensioned so that it fits entirely within the notch 56. Thus, the upper conductive layer 64 of the circuit component is positioned below or within the cylinder which forms the outer surface of the major portion of the contact body 46.

According to the present invention, the ground plate 32 is in the form of a relatively thin, resilient metallic ground foil which is somewhat similar to that disclosed in the aforementioned Tracy patent. The ground foil embodies a plurality of resilient spring fingers 70 about its outer periphery which engage the interior of the connector shell 12. However, only a single integral spring tang 72 is formed on the ground foil for each contact receiving opening 42. The tangs extend inwardly and forwardly to such an extent that when the contacts 44 are mounted in the insulator assembly, the tangs will engage the outer conductive layers 64 of the circuit components 60 on the contacts. Thus, it will be appreciated that only a single metallic ground member 32 is required to make electrical connection between all the circuit components on the contacts and the connector shell, thus avoiding the use of individual springs mounted on the respective contacts as in the aforementioned Nieman et al. connector. It is noted that the spring tangs must not engage the conductive contact bodies.

Figure 1A:
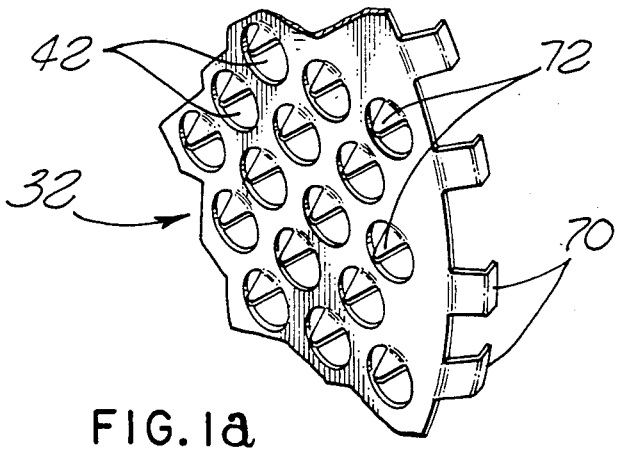
FIG. 1*a* is a fragmentary, perspective view of the ground foil of the invention used in the connector adapter illustrated in FIG. 1.
Figure 2:
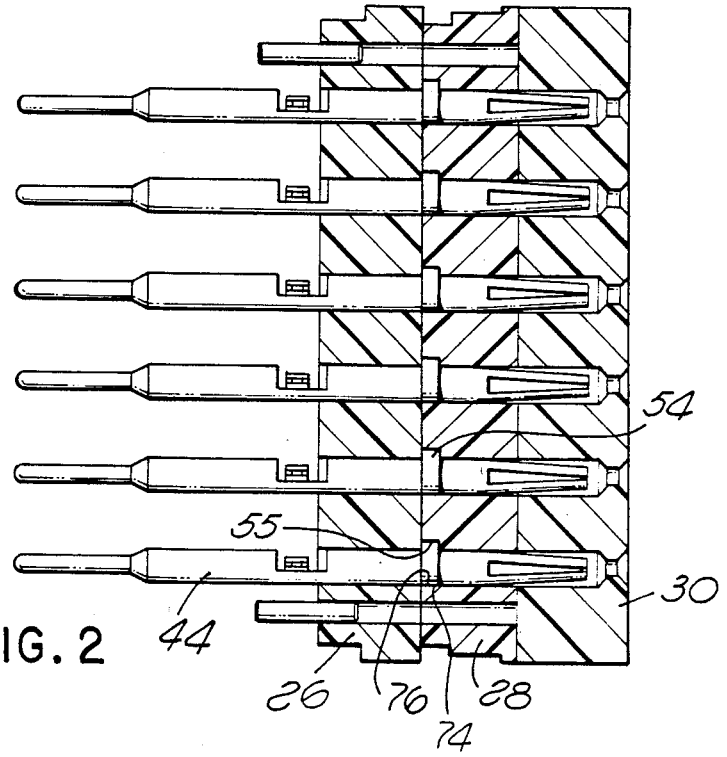
FIG. 2 is a partial sectional view through part of the insulator assembly used in the connector adapter illustrated in FIG. 1, with a plurality of contacts shown mounted therein.
Figure 3:
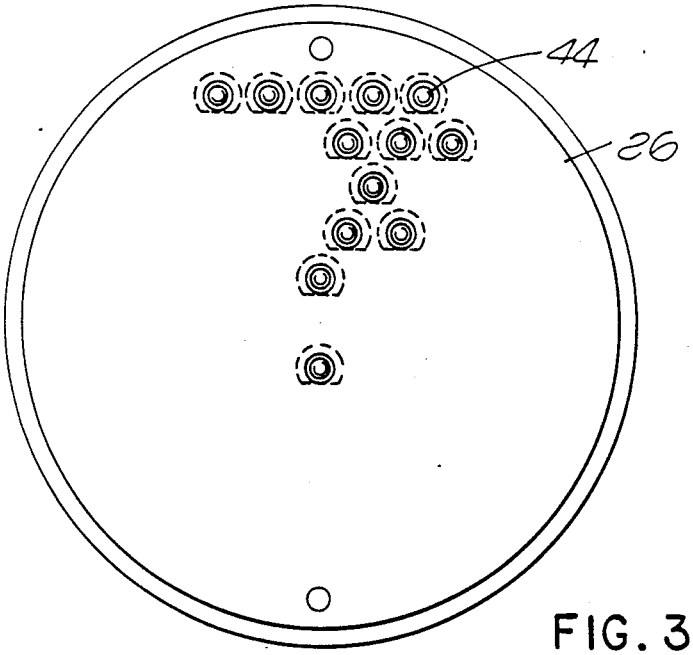
FIG. 3 is a front end view of the assembly illustrated in FIG. 2.
Figure 4:
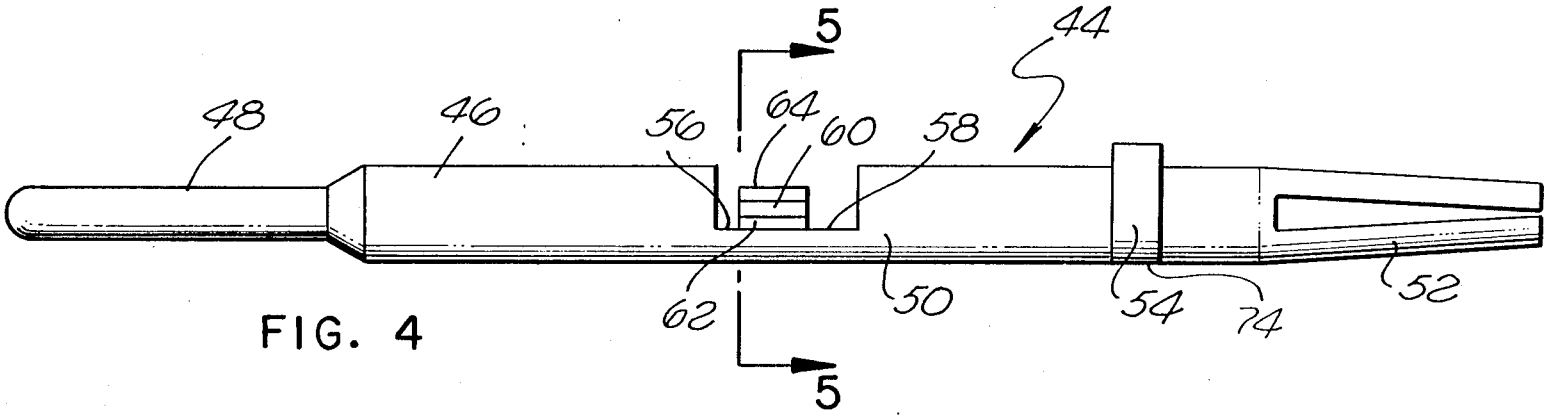
FIG. 4 is an enlarged side elevational view of one embodiment of the contact of the present invention with one electrical circuit component mounted thereon.
Figure 6:
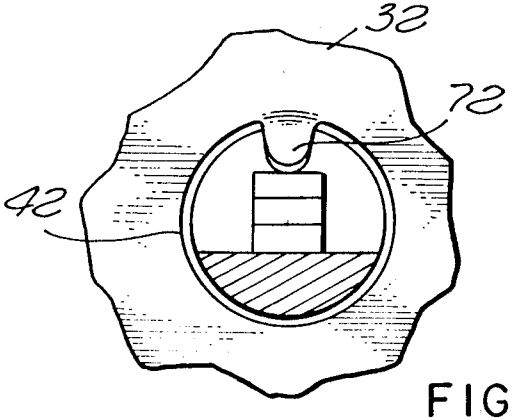
FIG. 6 is a fragmentary, transverse sectional view showing how the electrical component mounted on the contact of FIGS. 4 and 5 is engaged by a spring tang on the ground foil utilized in the connector adapter.

As seen in FIG. 1*a*, all the tangs 72 are connected to the upper edge of the holes 42 as the ground foil is viewed in the Figure. In order to make certain that the contacts are mounted in the insulator assembly so that the tangs 72 will engage the circuit components on the contacts, in accordance with the invention there is provided polarizing means which ensures that the contacts will be inserted in a predetermined proper angular orientation in the insulator assembly so that the circuit components thereon will face the tangs 72 on the upper edges of the holes 42 in the ground foil. To this end, the flange 54 on the contact body 46 is provided with a flat surface 74 tangent to the surface of the contact body. In the embodiment shown, the flat surface 74 is parallel to the bottom 58 of the notch 56, and is on the side of the contact body opposite to the notch. A corresponding flat surface 76 is formed along the bottom of the counterbore 55. The corresponding flat surfaces 74 and 76 on the contacts and contact passages, respectively, ensure that the contacts can be mounted in only one position in the passages wherein the circuit components 60 on the contacts will be properly positioned for engagement by the spring tangs 42 on the ground foil.

Figure 7:
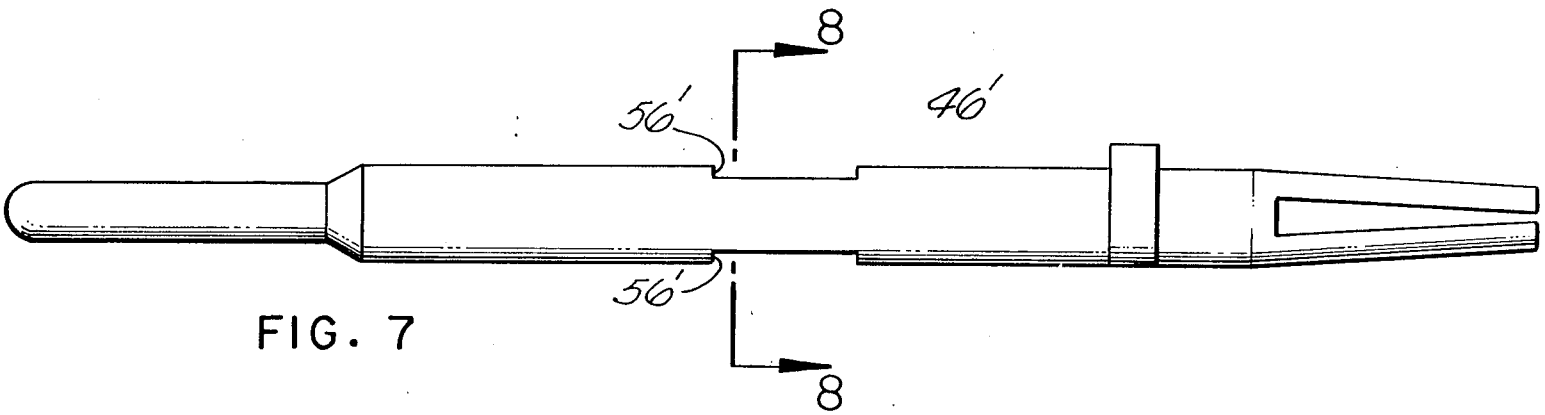
FIG. 7 is an enlarged side elevational view of a second embodiment of the contact of the present invention on which there are mounted two electrical circuit components.
Figure 9:
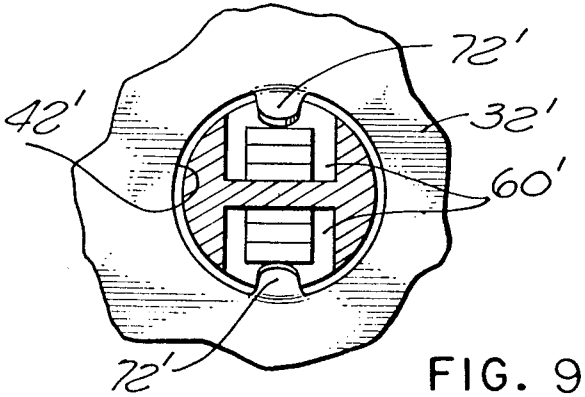
FIG. 9 is a fragmentary, transverse sectional view similar to FIG. 6 showing how a pair of spring tangs on the ground foil in the connector adapter engage the two electrical circuit components on the contact illustrated in FIGS. 7 and 8.
Figure 8:
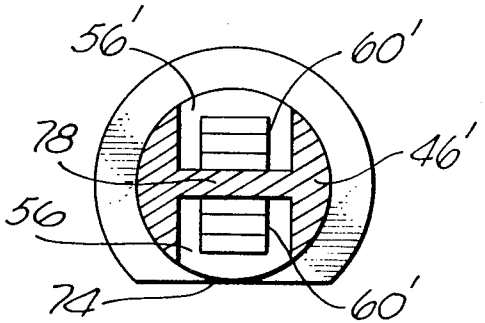
FIG. 8 is a transverse sectional view taken along line 8—8 of FIG. 7.

Reference is now made to FIGS. 7 to 9 which illustrate a modified form of the contact and ground foil of the present invention. In this embodiment the basic structure is as previously described and like numbers primed are used to indicate like or corresponding parts. In this embodiment, two recesses 56' are formed in the opposite sides of the contact body 46' for holding two electrical circuit components 60'. The recesses 56' are in the form of cylindrical bores which extend partially into the contact body providing a flat web 78 therebetween. In this embodiment, one of the circuit components may be a diode while the other may be a capacitor. The purpose for using cylindrical holes as the recesses for holding the circuit components is to maintain the maximum cross section area in the contact body for current flow through the contact. As seen in FIG. 9, the ground foil 32' is provided with two spring tangs 72' extending from both the upper and lower edges of the opening 42' in which the contact is mounted. The contact body has a flat polarizing surface 74' which cooperates with a flat surface in the contact passage in the connector insulator assembly to ensure that the contact is properly oriented so that the circuit components 60' will be engaged by the spring tangs 72' as seen in FIG. 9.

For a connector utilizing contacts having a very small diameter, it would be possible to mount the circuit components in longitudinally spaced notches formed in the contacts, and to use two longitudinally spaced ground foils for making electrical connection between the two sets of circuit components on the contacts and the shell of the connector.

What is claimed is:

1. An electrical contact comprising:

a generally cylindrical contact body;

bores extending partially into said cylindrical contact body on the opposite sides thereof transverse to the center axis of said body;

said bores being substantially aligned with each other;

a pair of electrical components mounted on opposite sides of said contact body mounted in said bores; and a flat polarizing surface on the side of said contact body adapted to engage a matching flat surface on the wall of a contact passage into which said contact is adapted to be mounted.

2. An electrical connector member comprising:

an electrical connector shell;

a ground plate in said shell in electrical contact therewith;

an opening extending through said plate, said plate embodying an integral resilient tang extending into said opening;

a contact mounted through said opening;

an electrical component non-concentrically mounted on said contact having an exposed surface facing said tang and resiliently engaged by said tang; and polarizing means cooperating with said contact permitting said contact to be mounted in said opening in a predetermined angular position wherein said electrical component will be engaged by said tang.

3. An electrical connector member comprising:

an electrical connector shell;

a ground plate in said shell in electrical contact therewith;

an insulator in said shell on one side of said plate and having a passage;

an opening extending through said plate and aligned with said insulator passage, said plate embodying an integral resilient tang extending into said opening;

a contact mounted through said passage and said opening;

an electrical component mounted on the side of said contact facing said tang and resiliently engaged by said tang; and wherein said contact has a generally cylindrical body but with a flat matching surface, and said passage is generally cylindrical with a flat surface matching that of said contact body, to permit said contact to be mounted in a predetermined angular position;

said contact body has a recess formed therein that forms a relatively flat supporting surface that is generally parallel to said flat matching surface; and said electrical component is mounted on said supporting surface.

4. An electrical connector member comprising:

an electrical connector shell;

a ground plate in said shell in electrical contact therewith;

an opening extending through said plate, said plate embodying an integral resilient tang extending into said opening;

a contact mounted through said opening, said contact having a generally cylindrical body;

an electrical component mounted on the side of said contact facing said tang and resiliently engaged by said tang; and polarizing means cooperating with said contact permitting said contact to be mounted in said opening in a predetermined angular position wherein said electrical component will be engaged by said tang;

said cylindrical body of said contact has a bore extending partially therein, said bore being transverse to the center axis of the body and generally aligned with said tang;

said electrical component is mounted in said bore.

5. An electrical connector member comprising:

an electrical connector shell;

a ground plate in said shell in electrical contact therewith;

an opening extending through said plate, said plate embodying a pair of integral resilient tangs extending into opposite sides of said opening;

a contact mounted through said opening;

a pair of electrical components mounted on opposite sides of said contact facing said tangs and each resiliently engaged by one of said tangs; and polarizing means cooperating with said contact permitting said contact to be mounted in said opening in a predetermined angular position wherein said electrical component will be engaged by said tang.

6. An electrical connector member as set forth in claim 5 wherein:

said contact has a generally cylindrical body;

bores extending partially into said cylindrical body on the opposite sides thereof transverse to the center axis of said body;

said bores are generally aligned with each other and said tangs; and said components are mounted in said bores.

* * * * *